United States Patent [19]

Grindley et al.

[11] 4,082,037

[45] Apr. 4, 1978

[54] APPARATUS FOR REMOVING DUSTING POWDER IN OFFSET PRESSES

[76] Inventors: C. Ronald Grindley, 108 W. 15th, Higginsville, Mo. 64037; Larry G. Boyd, 7111 E. 107th Ter., Kansas City, Mo. 64134

[21] Appl. No.: 626,456

[22] Filed: Oct. 28, 1975

[51] Int. Cl.[2] ..... B41F 35/00; B41L 41/00

[52] U.S. Cl. ..... 101/425; 101/426

[58] Field of Search ..... 101/425, 409, 415.1, 101/246

[56] References Cited

U.S. PATENT DOCUMENTS

| | | | |
|---|---|---|---|
| 437,863 | 10/1890 | Marvin et al. | 101/425 |
| 511,934 | 1/1894 | Cottrell | 101/425 |
| 1,043,812 | 11/1912 | Doyle | 101/425 |
| 1,120,840 | 12/1914 | Niles | 101/425 |
| 1,428,931 | 9/1922 | Barber | 101/425 X |
| 1,744,913 | 1/1930 | Meck | 101/425 |
| 2,363,817 | 11/1944 | Taylor | 101/425 |
| 2,569,738 | 10/1951 | Stephenson | 101/415.1 |
| 2,655,866 | 10/1953 | Linsley, Jr. | 101/415.1 |
| 2,691,344 | 10/1954 | McMullen | 101/425 |
| 2,751,616 | 6/1956 | Turner, Jr. et al. | 101/425 X |
| 2,752,271 | 6/1956 | Walkup et al. | 101/425 X |
| 2,944,484 | 7/1960 | Bruce | 101/425 |
| 3,207,897 | 9/1965 | Limberger | 101/409 X |
| 3,309,993 | 3/1967 | Grembecki et al. | 101/425 |
| 3,537,391 | 11/1970 | Mowry et al. | 101/246 X |
| 3,592,136 | 7/1971 | Selman | 101/425 |
| 3,656,200 | 4/1976 | Riley, Jr. | 101/425 X |
| 3,771,450 | 11/1973 | Cleybergh | 101/425 |

*Primary Examiner*—Louis G. Mancene
*Assistant Examiner*—Paul J. Hirsch
*Attorney, Agent, or Firm*—D. A. N. Chase

[57] ABSTRACT

A cleaning roller having a soft fibrous surface (such as lamb's wool roller) is disposed ahead of the blanket cylinder of an offset press, the surface presenting a nap which swells upon rotation of the roller to wipe particulate matter (dusting powder or residue particles) from the paper sheets before the same are printed. A trough containing water (in which the particles are soluble) extends parallel to the roller and receives the particles stripped from the roller by a doctor blade. The removed particles are directed from the blade to the trough by a guide surface continuous with the blade which is presented by a specially shaped sheet member extending from the blade into the trough. The water may be recirculated by a pump, or supplied and drained at a rate to prevent the particles from accumulating.

10 Claims, 8 Drawing Figures

APPARATUS FOR REMOVING DUSTING POWDER IN OFFSET PRESSES

This invention relates to improvements in apparatus for removing dusting powder or residue particles from paper sheets during movement of the sheets in a printing press, and prior to the printing (or reprinting) thereof.

In offset lithography, it is common practice to apply dusting powder to freshly printed sheets as they are delivered from the blanket cylinder of the press in order to promote drying and prevent unintentional transfer of ink (set off) when the sheets are stacked in face-to-face contact. However, if it is desired to rerun the sheets for overprinting or multicolor work, it is necessary that the powder be removed. Accordingly, when the final printed product is the result of superimposing a number of different colors, the dusting powder is removed and reapplied in each successive run. Besides dusting powder, unprinted sheets direct from a paper mill may have residue particles deposited thereon as a result of the milling process, and it is also desired to clean these sheets as they are run.

Various devices are currently employed in offset presses to remove the dusting powder from the sheets (or continuous paper web in web-fed presses) prior to passage of the sheets between the impression and blanket cylinders. One such device employs a suction head having a stationary brush assembly which engages the surface of each passing sheet to sweep up the powder. This arrangement suffers from the disadvantage that the brushes tend to accumulate ink, thereby requiring frequent replacement, and the suction mechanism is inherently bulky and noisy in operation. Another approach is to employ a cotton roller in conjunction with a vacuum system to carry away the removed powder, but here again the mechanism is inherently noisy. Furthermore, the cotton roller is run in contact with the impression cylinder grippers and is, therefore, subject to uneven wear and at times snags the leading edge of a sheet. The resulting jam requires that the operation of the press be temporarily interrupted to correct the condition.

It is, therefore, the primary object of the present invention to provide apparatus for use in printing presses for removing dusting powder and residue particles, which is relatively simple in construction, easy to maintain, and does not possess the disadvantages mentioned above.

Another important object of this invention is to provide apparatus as aforesaid which wipes the particulate matter from the sheets and then dissolves the particles in a liquid in which the particles are soluble, thereby removing the particles without employing vacuum equipment.

Still another important object of the invention is to provide apparatus as aforesaid in which the particles are wiped from the sheets by a roller and transferred to a receiver containing the liquid in which the particles are soluble, wherein such transfer is accomplished by flow of the particles from the roller to the receiver without resort to suction devices or other complex mechanical equipment.

Still another important object is to provide apparatus of the type discussed above employing a cleaning roller in wiping contact with the sheets, wherein the wiping surface of the roller is soft and fibrous and presents a nap which extends radially outwardly under centrifugal force into light contact with the sheets, thereby precluding jamming and minimizing wear on the roller.

Yet another important object is to provide such an apparatus in which the position of the roller may be precisely set and adjusted to control the wiping action, and wherein the roller when properly positioned will not cause a jam condition.

Additionally, another important aim of this invention is to provide apparatus as aforesaid wherein the cleaning roller is protected from the paper grippers carried by the impression cylinder of the press, through the use of a special shield which prevents grooving of the surface of the roller when the latter is rotating and the nap is radially extended.

Figure 1:
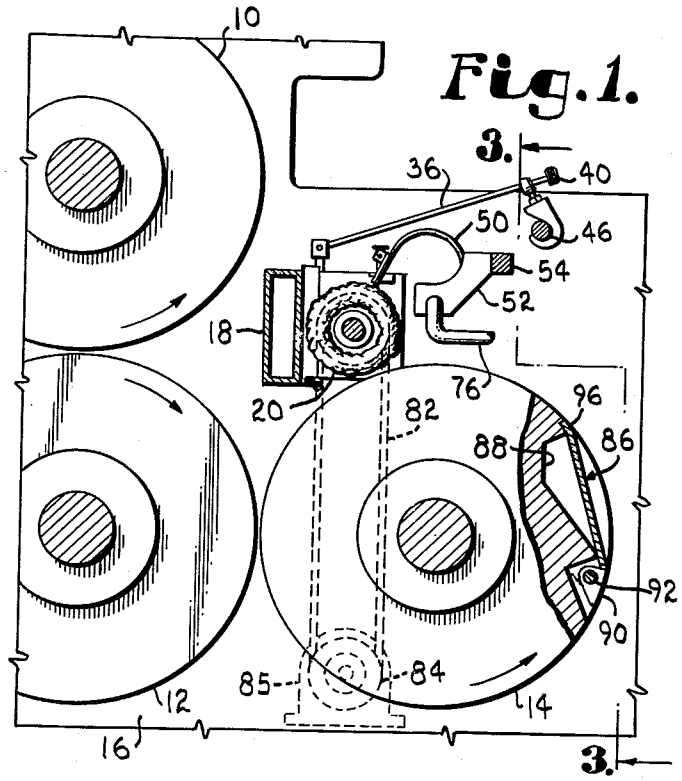
FIG. 1 is a vertical cross-section viewing the apparatus of the present invention from one side of an offset press on which the apparatus is installed, the press itself being shown fragmentarily and diagrammatically.
Figure 2:
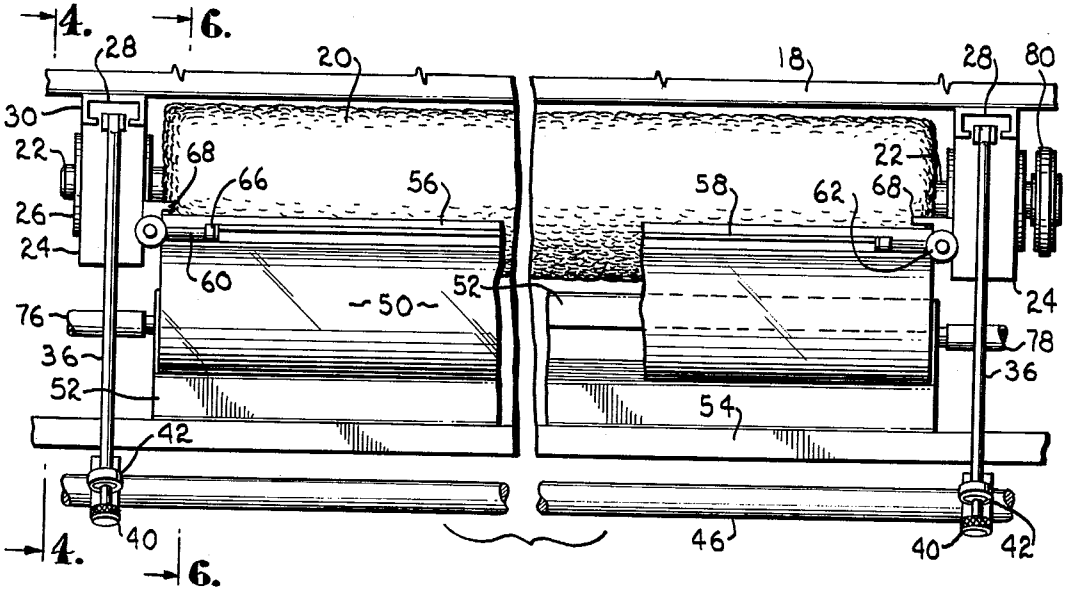
FIG. 2 is an enlarged, plan view of the apparatus of FIG. 1, certain parts being broken away for clarity.

Referring initially to FIG. 1, the plate cylinder 10, blanket cylinder 12 and impression cylinder 14 of a typical offset press are illustrated diagrammatically, it being understood that the ink and dampening mechanisms and associated transfer rollers are not shown since they are conventional components and form no part of the present invention. A portion of one side frame 16 may be seen in FIG. 1, along with a box member 18 of the press frame that extends across the press parallel with the axes of the cylinders 10, 12 and 14. The member 18 is just above the nip of the blanket cylinder 12 and the impression cylinder 14 and, therefore, provides a suitable mount for the apparatus of the present invention to now be described.

Viewing FIGS. 2–4 and 6 in conjunction with FIG. 1, a cylindrical cleaning roller 20 has an axle 22 projecting from the opposed ends of the roller 20. The roller is formed by a cylindrical core (not visible) over which a closely fitting sheath of lamb's wool is slipped and tightly secured. A pair of end supports for the roller 20 are provided by bearing blocks 24, each of which carries a bearing 26 that rotatably supports the associated end portion of the axle 22. Each of the blocks 24 has an integral, T-shaped tongue 28 received within a corresponding vertical track 30 provided by an upright channel member fixed to the box member 18. As is clear in the figures, the bight or web of each channel is secured to the face of the member 18, with the flanges of the channel projecting toward the axle 22 and having inturned edges forming a vertical passage receiving the complementally shaped tongue 28. The two tracks 30 are horizontally spaced along the member 18 and located just outside the respective ends of the impression cylinder 14. The cleaning roller 20 has a length approximately equal to the length of the impression cylinder 14 (FIG. 3); thus the cylindrical surface of the roller 20 can accommodate any size sheet being handled by the press.

Figure 4:
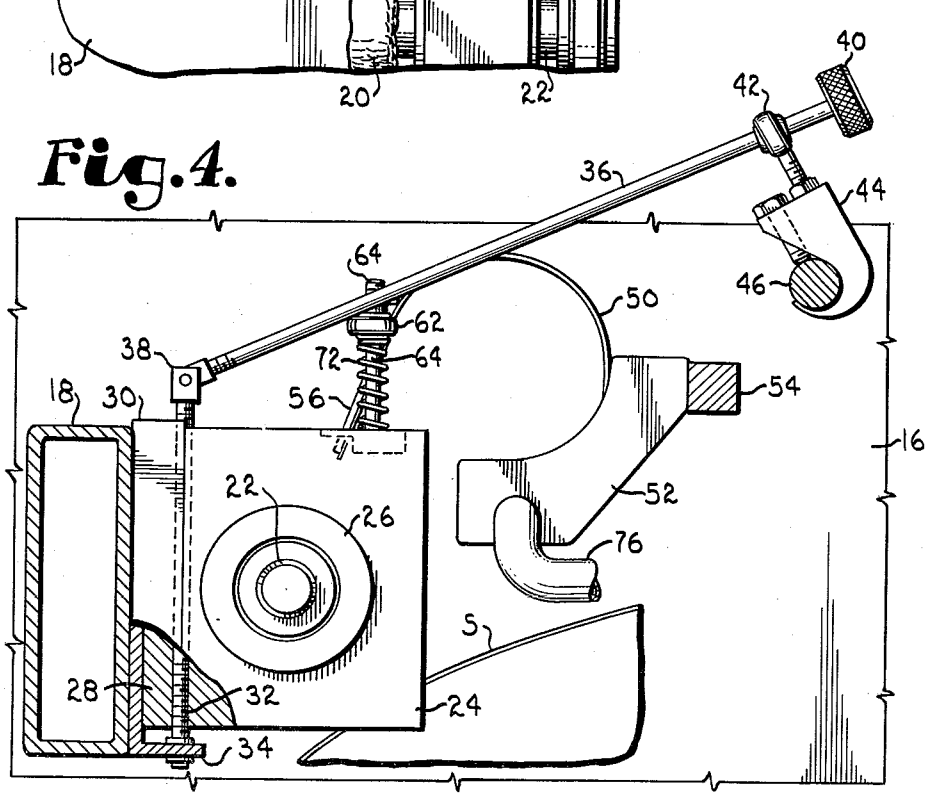
FIG. 4 is further enlarged as compared with FIG. 2, and is a vertical sectional view taken along line 4—4 of FIG. 2.

The bearing blocks 24 are slidable in the corresponding tracks 30 to adjust the vertical position of the roller 20, this being accomplished by a pair of upright screws 32 rotatably supported on base flanges 34 integral with the tracks 30 at their lower ends (FIG. 4). Each of the screws 32 is, in turn, threadably received in a vertically extending, tapped opening through the tongue 28 of a corresponding block 24 so that, as the screws 32 rotate, the bearing blocks 24 slide upwardly or downwardly in the tracks 30. Each of the screws 32 is rotated by a shaft 36 connected to the upper end thereof by a universal joint 38, the shaft 36 extending upwardly at an angle away from the press cylinders and terminating in a knob 40. The shaft 36 is supported adjacent its upper end by a bearing 42 mounted on a clamp 44 which embraces a cross rod 46 forming a part of the frame of the press. As is clear in FIG. 2, each of the screws 32 is provided with an identical rotating mechanism as just described, the two knobs 40 being disposed well above the respective ends of the impression cylinder 14 where they may be conveniently grasped and manipulated by the pressman.

As will be explained, the function of the roller 20 is to wipe dusting powder from the sheets on the impression cylinder 14 just prior to reprinting, which occurs at the nip of the impression cylinder 14 and blanket cylinder 12. Cornstarch is commonly used as the dusting powder, and is soluble in water. The powder collected by the surface of the roller 20 is stripped therefrom by the action of a doctor blade 48 which extends the length of the roller 20 in parallelism with the rotative axis of the roller defined by the axle 22. A sheet member such as a sheet of mylar plastic presents the blade 48 and also provides a guide 50 to convey the powder from the blade 48 to a trough 52 located directly above the impression cylinder 14. The trough 52 is partially filled with water and extends the length of the roller 20 in parallelism therewith, and is supported by a crossbar 54 whose ends are suitably secured to the frame of the press.

Figure 5:
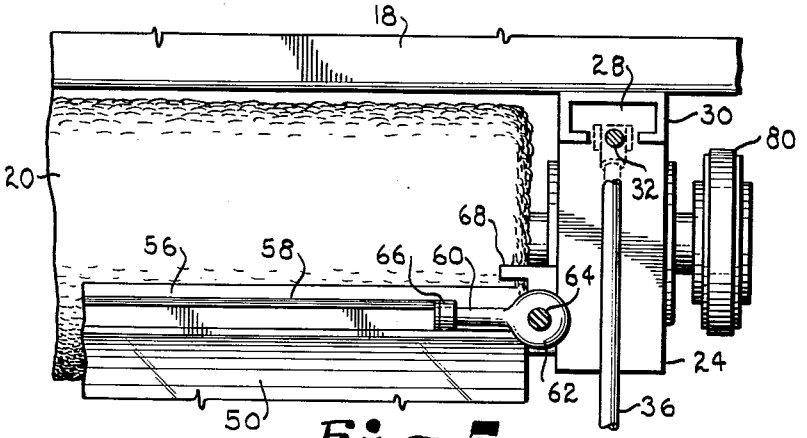
FIG. 5 is on the same scale as FIG. 4, and is a fragmentary plan view showing the drive end (right end in FIG. 2) of the cleaning roller.
Figure 6:
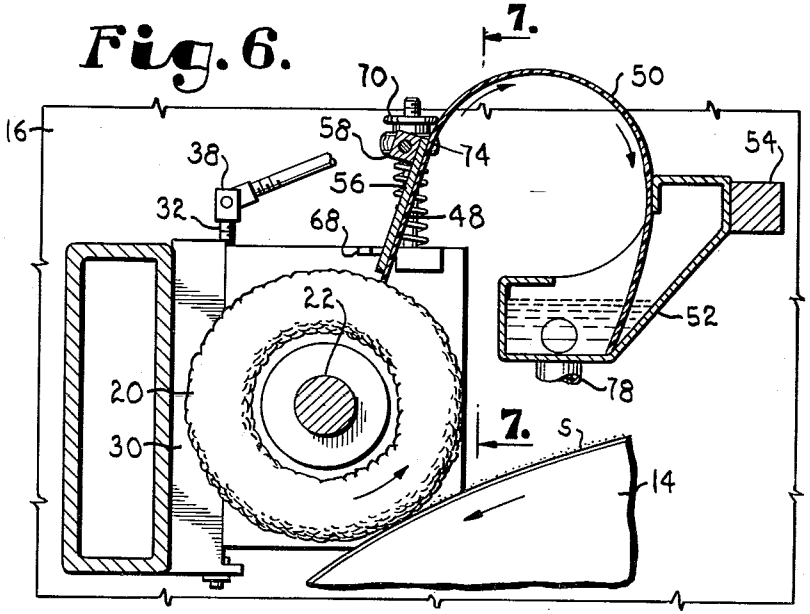
FIG. 6 is on the same scale as FIG. 4, and is a vertical sectional view taken along line 6—6 of FIG. 2, the roller surface itself being shown in end elevation.
Figure 7:
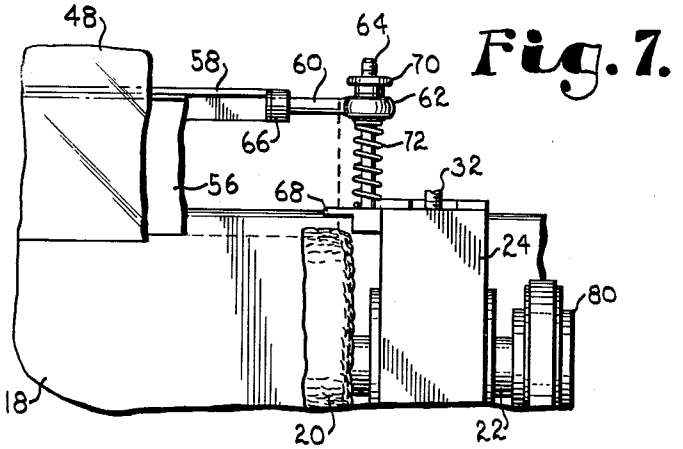
FIG. 7 is a fragmentary, vertical sectional view taken along line 7—7 of FIG. 6 and illustrates components at the drive end of the roller in elevation, certain parts being broken away and shown in broken lines to reveal details of construction.

In order to impart rigidity to the doctor blade 48, an elongated, rectangular backing plate 56 is adhered to the sheet material and, at its upper longitudinal margin, is secured to a square shaft 58 having a cylindrical bore through which a support rod 60 extends horizontally above the roller 20 and parallel to its axis of rotation. The opposed ends of the rod 60 are provided with collars 62 which slip over a pair of upright, threaded shanks 64 on corresponding bearing blocks 24 (see particularly FIGS. 5 and 7). In FIG. 7 the doctor blade portion 48 of the sheet member is broken away, and part of the backing plate 56 is likewise broken away and shown in broken lines to better reveal the construction. A pair of retainers 66 on rod 60 spaced inwardly from collars 62 prevent longitudinal movement of the shaft 58, but the same is permitted to turn on rod 60 clockwise as viewed in FIGS. 1, 4 and 6 to a position limited by a pair of inwardly projecting stops 68 on bearing blocks 24.

The position of the doctor blade 48 relative to the roller 20 is adjusted by a pair of nuts 70 on the shanks 64. Each of the collars 62 is captured between the associated nut 70 and an underlying coil spring 72 in compression on the shank 64.

The guide 50 is curved as viewed from the side edge of the sheet member (see particularly FIG. 6) and extends upwardly to the rear and then downwardly into the trough 52 where it terminates at the bottom of the trough. Since a single sheet member forms both the surface of the doctor blade 48 and presents the under surface of the curved portion of the guide 50, it is apparent that the guide member and blade are joined at their common margin 74 and that, therefore, the guide surface is continuous with the blade. As illustrated by the arrows in FIG. 6, powder stripped from the roller 20 flows along this guide surface into the trough 52, as will be discussed in greater detail hereinbelow. A pipe 76 communicates with the trough 52 at one end thereof for the purpose of supplying water, and a pipe 78 at the opposite end of the trough serves as an outlet or drain.

The roller 20 is driven in a manner as may be best suited to the particular press with which the apparatus is utilized. As illustrated herein, a pulley 80 on one end of the axle 22 may be connected by a belt 82 to a drive pulley 84 on the shaft of an electric motor 85 (illustrated in broken lines in FIG. 1).

Figure 3:
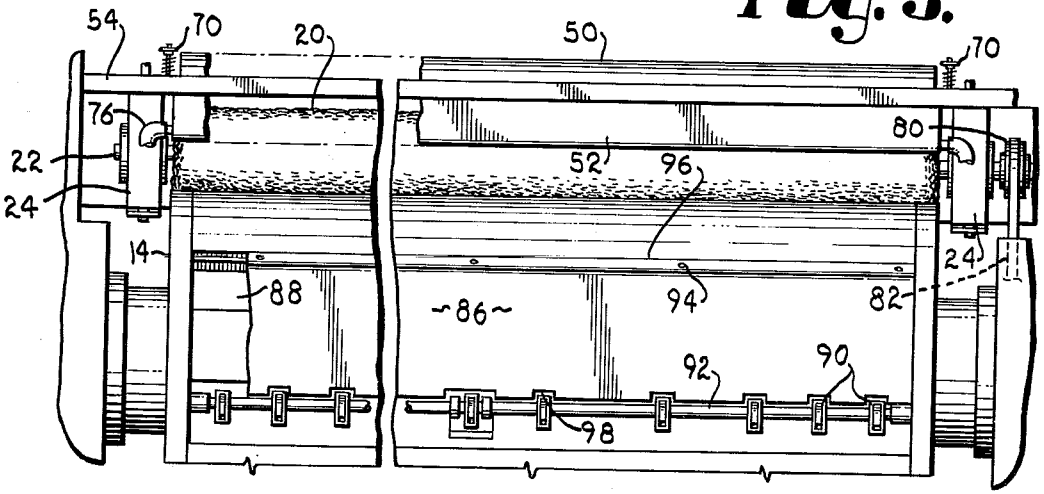
FIG. 3 is a vertical sectional view on the same scale as FIG. 1 and taken along line 3—3 of FIG. 1, and shows the apparatus of the present invention and the adjacent impression cylinder of the press.
Figure 8:
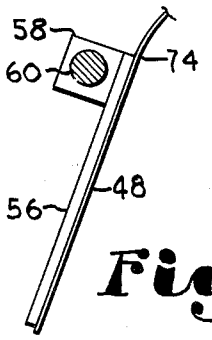
FIG. 8 is a detail view of the doctor blade as seen from one end edge.

A shield 86 is secured to the impression cylinder 14 over the gap 88 in the otherwise cylindrical surface which houses the grippers 90 of the in-feed mechanism of the press. The grippers 90 are arranged on a gripper shaft 92 and, as is conventional, receive the leading edge of each sheet from the feeder (not shown) of the press in order to pull the sheet forward with the rotating impression cylinder 14 and accelerate the sheet to the surface speed of the impression cylinder. The shield 86 is formed by an elongated, flat, rectangular plate, one longitudinal edge thereof being presented by an inturned lip 96 which is secured to the cylinder 14 by a row of screws 94. The opposite longitudinal edge of the plate is provided with a series of notches 98 receiving and clearing corresponding grippers 90 (FIG. 3). The notches 98 are in the trailing longitudinal edge of the shield 86 relative to the direction of rotation of the cylinder 14. In some presses the grippers 90 may cause grooving of the surface of the roller 20 unless the shield 86 is used to minimize contact with the grippers as the gap 88 passes the roller on each revolution of the cylinder 14.

In operation, by turning the knobs 40 the cleaning roller 20 is preferably adjusted so that the cylindrical cleaning surface is closely spaced (but not quite in contact) from both the impression cylinder 14 and the doctor blade 48. As a guide, the roller 20 should be set as close to the impression cylinder 14 as possible while still allowing light to pass through the gap. This applies also for the gap between the roller and the doctor blade 48, which may be controlled by adjusting the nuts 70. Accordingly, when the roller 20 is adjusted in this manner, a sheet of paper on the impression cylinder 14 while the press parts and roller 20 are stationary is out of contact with the surface of the roller 20. However, when the press is in operation and the roller 20 is turning, centrifugal force causes the nap of the soft, fibrous roller surface to extend radially outwardly into light wiping contact with the sheets successively advanced by the impression cylinder 14. This is illustrated in FIG. 6 where a sheet S is shown on the cylinder 14, the outer surface of the sheet S being wiped by the nap of the roller 20. As the arrows indicate, the roller 20 is driven counterclockwise or opposite to the direction of rotation of the cylinder 14. The rotative speed is relatively slow and will vary depending upon the application, a suggested range being from 1,400 to 1,750 rpm for a roller from three to four inches in diameter. It is important that high roller speeds sufficient to create significant peripheral air currents be avoided, as such currents tend to lift the leading edges of the sheets and cause a jam.

The dusting powder collected by the nap of the roller 20 is removed by the doctor blade 48 which is now in contact with the raised nap of the rotating roller 20. The collected powder is stripped from the fibers by the blade 48 and deflected upwardly and to the right as viewed in FIG. 6, the powder thus being directed into the guide member 50 and caused to flow along the curved undersurface presented by the guide member and into the trough 52. Since the powder is water soluble, it is immediately dissolved in the water within the trough 52 and carried away by the pipe 78. The water may be recirculated through the trough by a pump (not shown) or supplied by the pipe 76 and drained by the pipe 78 at a rate selected to prevent the powder from accumulating in the trough 52. Operation is the same when the apparatus is used to clean residue particles from unprinted sheets.

Although the present invention is described in connection with the removal of dusting powder or residue particles from sheets, it is equally effective in removing particulate matter from a continuous paper web under movement with the impression cylinder in a web-fed press. Accordingly, the term "sheets" in the appended claims is understood to encompass a continuous web as well as successively fed sheets.

Having thus described the invention, what is claimed as new and desired to be secured by Letters Patent is:

1. Apparatus for removing liquid-mixable, dry particulate matter from sheets under movement in a printing press, said apparatus comprising:

a cleaning roller having a dry, soft, fibrous surface adapted for wiping contact with said sheets;

means for supporting said roller adjacent said sheets;

drive means connected with said roller for rotating the latter to cause said surface thereof to wipe said sheets and collect said dry particulate matter;

a receiver spaced from said roller;

a doctor blade engaging said surface as the roller rotates for stripping the collected matter therefrom;

guide means for receiving the particulate matter stripped from said surface by said blade, and including a member extending from adjacent said blade to said receiver, said member having a guide surface defining a flow path adjacent said guide surface along which the stripped matter flows under the centrifugal force of the rotating roller, whereby the stripped matter is directed into the receiver by the action of the roller, doctor blade and guide means; and a quantity of liquid in which the stripped matter is mixable, said liquid being contained in said receiver for retaining the stripped matter directed thereinto, whereby the retained matter is carried away upon removal of the liquid from the receiver and resupply of liquid thereto.

2. The apparatus as claimed in claim 1, wherein said member is coextensive with said blade and said guide surface extends transversely outwardly from said blade.

3. The apparatus as claimed in claim 1, wherein said member comprises a sheet having a marginal portion joined to said blade, said sheet member presenting said guide surface continuous with the blade and extending transversely outwardly therefrom.

4. The apparatus as claimed in claim 3, wherein said receiver comprises a trough disposed in generally parallel relationship with the axis of rotation of said roller, said blade extending longitudinally of said roller, said member having an opposite marginal portion terminating within said trough.

5. The apparatus as claimed in claim 1, wherein means is provided communicating with said receiver for supplying said liquid thereto and draining matter-containing liquid therefrom.

6. The apparatus as claimed in claim 1, wherein said surface presents a nap and wherein said supporting means positions said roller with said surface thereof closely spaced from said sheets when the roller is stationary, and further wherein said drive means upon rotation of the roller causes said nap to extend radially outwardly under centrifugal force into light wiping contact with said sheets, said drive means limiting the speed of rotation of the roller such that the creation of significant peripheral air currents capable of lifting the sheets is prevented.

7. Apparatus for removing liquid-mixable, dry particulate matter from sheets under movement in a printing press, said apparatus comprising:

a cleaning roller having a cylindrical, dry, soft, fibrous surface presenting a nap;

support means for positioning said roller with said surface thereof closely spaced from said sheets when the roller is stationary;

drive means connected with said roller for rotating the latter to cause said nap to extend radially outwardly under centrifugal force and into light wiping contact with said sheets, whereby the surface of the roller collects said dry particulate matter, said drive means limiting the speed of rotation of the roller such that the creation of significant peripheral air currents capable of lifting the sheets is prevented;

stripping means operably associated with said roller for removing the collected matter from said surface;

a receiver spaced from said roller;

guide means operably associated with said stripping means for defining a flow path from the surface to the receiver along which the stripped matter flows under the centrifugal force of the rotating roller; and a quantity of liquid in which the stripped matter is mixable, said liquid being contained in said receiver for retaining the stripped matter directed thereinto, whereby the retained matter is carried away upon removal of the liquid from the receiver and resupply of liquid thereto.

8. The apparatus as claimed in claim 7, wherein said roller is provided with an axle projecting from opposite ends thereof, and wherein said support means includes a pair of spaced end supports having bearing means receiving said axle, a pair of parallel tracks receiving corresponding end supports for movement therealong in directions causing said surface of the roller to move toward or away from said sheets, and adjustable means for shifting said end supports along said tracks to a selected position that provides the desired spacing between said sheets and the surface of the roller when stationary.

9. The apparatus as claimed in claim 7, wherein said sheets are under movement on an impression cylinder of said printing press having grippers that engage the sheets, and wherein a shield is provided on said cylinder for preventing the grippers from grooving said surface of the roller when the latter is rotating and the nap is radially extended.

10. A method for removing dry particulate matter from sheets under movement in a printing press, said method comprising the steps of:

providing a cleaning roller having a cylindrical, dry, soft fibrous surface presenting a nap;

positioning said roller with said surface thereof closely spaced from said sheets when the roller is stationary;

rotating the roller to cause said nap to extend radially outwardly under centrifugal force and into light wiping contact with said sheets, whereby the surface of the roller collects said dry particulate matter;

limiting the speed of rotation of the roller such that the creation of significant peripheral air currents capable of lifting the sheets is prevented;

stripping the collected matter from the surface of the roller; and guiding the stripped matter away from the roller to a receiver therefor, by providing a flow path along which the stripped matter flows under the centrifugal force of the rotating roller.

* * * * *